US009517632B2

(12) United States Patent
Takagi et al.

(10) Patent No.: US 9,517,632 B2
(45) **Date of Patent: *Dec. 13, 2016**

(54) INK CONTAINING DEVICE

(71) Applicant: Brother Kogyo Kabushiki Kaisha, Nagoya-shi, Aichi-ken (JP)

(72) Inventors: Yuki Takagi, Nagoya (JP); Tomohiro Kanbe, Nagoya (JP); Yasuhiro Kato, Nagoya (JP); Hirotake Nakamura, Nagoya (JP); Hirofumi Kondo, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/838,665

(22) Filed: Aug. 28, 2015

(65) Prior Publication Data

US 2016/0059569 A1 Mar. 3, 2016

Related U.S. Application Data

(63) Continuation of application No. 13/975,252, filed on Aug. 23, 2013, now Pat. No. 9,132,653.

(30) Foreign Application Priority Data

Aug. 24, 2012 (JP) ..... 2012-185499

(51) Int. Cl.
*B41J 2/175* (2006.01)

(52) U.S. Cl.
CPC ..... *B41J 2/1753* (2013.01); *B41J 2/1752* (2013.01); *B41J 2/17553* (2013.01)

(58) Field of Classification Search
CPC ..... B41J 2/1752; B41J 2/1753; B41J 2/17552
(Continued)

(56) References Cited

U.S. PATENT DOCUMENTS 6,286,949 B1 * 9/2001 Lewis ..... B41J 2/17509 347/86
6,502,916 B1 1/2003 Naka
(Continued)

FOREIGN PATENT DOCUMENTS

JP 2000-158642 A 6/2000
JP 2003-341100 A 12/2003
(Continued)

OTHER PUBLICATIONS

Japan Patent Office, Office Action issued for Japanese Patent Application No. JP 2012-185499, mailed Jan. 26, 2016.
Japan Patent Office, Notification of Reasons for Rejection issued for related Japanese Patent Application No. JP 2012-185499, mailed Aug. 9, 2016.

*Primary Examiner* — Stephen Meier
*Assistant Examiner* — Alexander D Shenderov
(74) *Attorney, Agent, or Firm* — Baker Botts L.L.P.

(57) ABSTRACT

An ink containing device comprises an ink cartridge and an adaptor. The ink cartridge comprises a first main body comprising a chamber configured to store ink, an ink outlet portion disposed on a first surface of the first main body configured to direct the ink from the chamber to an exterior of the first main body wherein the first surface faces a first direction, and an electrical interface disposed on the first main body. The adaptor is configured to be in an attached state with the ink cartridge. The adaptor comprises a second main body comprising a first contact disposed on a particular surface facing a particular direction, and a second contact disposed on a further surface and electrically connected to the first contact, wherein the second contact is electrically connected to the electrical interface in the attached state.

17 Claims, 9 Drawing Sheets

(58) Field of Classification Search
USPC ..... 347/85–87
See application file for complete search history.

(56) References Cited

U.S. PATENT DOCUMENTS

| | | | | |
|---|---|---|---|---|
| 6,969,136 | B1 | 11/2005 | Matsumoto et al. | |
| 8,833,905 | B2 * | 9/2014 | Kanbe | B41J 2/17526 347/49 |
| 9,108,418 | B2 * | 8/2015 | Kanbe | B41J 2/17526 |
| 2002/0003556 | A1 | 1/2002 | Mori | |
| 2002/0109761 | A1 | 8/2002 | Shimizu et al. | |
| 2002/0122098 | A1 | 9/2002 | Sekiya | |
| 2003/0222940 | A1 | 12/2003 | Seino et al. | |
| 2007/0206076 | A1 | 9/2007 | Seino et al. | |
| 2009/0039002 | A1 * | 2/2009 | Umeda | B41J 2/17509 210/100 |
| 2009/0195625 | A1 | 8/2009 | Sekino et al. | |
| 2009/0322835 | A1 | 12/2009 | Kanbe et al. | |
| 2010/0155417 | A1 | 6/2010 | Utzui et al. | |
| 2012/0056954 | A1 | 3/2012 | Asauchi et al. | |

FOREIGN PATENT DOCUMENTS

| | | | |
|---|---|---|---|
| JP | 2004-322659 | A | 11/2004 |
| JP | 2009-132098 | A | 6/2009 |
| JP | 2010-012608 | A | 1/2010 |
| JP | 2010-162867 | A | 7/2010 |
| WO | 2012029311 | A1 | 3/2012 |

* cited by examiner

INK CONTAINING DEVICE

CROSS-REFERENCE TO RELATED APPLICATION

This application is a continuation of U.S. patent application Ser. No. 13/975,252 filed on Aug. 23, 2013, which claims priority from Japanese Patent Application No. 2012-185499 filed on Aug. 24, 2012, the disclosures of which are incorporated herein by reference in its their entirety.

BACKGROUND OF THE INVENTION

Field of the Invention

The invention relates generally to an ink containing device comprising an ink cartridge and an adaptor.

Description of Related Art

An image recording apparatus records an image on a recording sheet using ink. The image recording apparatus includes an inkjet recording head and selectively ejects ink droplets from nozzles of the recording head onto a recording sheet. The ink droplets land on the recording sheet to record a desired image on the recording sheet. The image recording apparatus includes an ink cartridge storing ink therein to supply ink to the recording head. The ink cartridge may be removably mounted to a cartridge mounting portion provided in the image recording apparatus.

SUMMARY OF THE INVENTION

The ink cartridge may include an electronic component, e.g., a memory module, to store data relating to ink color, ink material, a residual amount of ink, and a maintenance condition. The memory module may be electrically connected with a contact disposed on the mounting portion when the ink cartridge is mounted to the cartridge mounting portion. Data stored in the memory module may be read via the contact.

The contact disposed on the mounting portion may be worn or deteriorated as the contact slidably contacts with the electronic component when the ink cartridge is replaced. It may be difficult for users to replace the contact on the mounting portion. An electronic component, e.g., a memory module, may be provided on an adaptor. An ink cartridge may be removed from the mounting portion while the adaptor remains in the mounting portion. As the electronic component remains in the mounting portion, the data stored in the electronic component may not be renewed or updated when the ink cartridge is replaced.

Thus, embodiments of the invention may provide an ink containing device comprising an adaptor and an ink cartridge in which information may be renewed or updated and wear of a contact of an ink supply device may be reduced.

According to an embodiment of the invention, an ink containing device comprises an ink cartridge comprising a first main body comprising a chamber configured to store ink, and an ink outlet portion disposed on a first surface of the first main body configured to direct the ink from the chamber to an exterior of the first main body, wherein the first surface faces a first direction, and an electrical interface disposed on the first main body, and an adaptor configured to be in an attached state with the ink cartridge, the adaptor comprising a second main body comprising a first contact disposed on a particular surface facing a particular direction, and a second contact disposed on a further surface, which is different from the particular surface and is facing a further direction, wherein the second contact is electrically connected to the first contact, and wherein the second contact is configured to be electrically connected to the electrical interface in the attached state.

The ink cartridge may be used by mounting the ink cartridge to a cartridge mounting portion together with the adaptor. As ink stored in the ink cartridge is depleted, the ink cartridge may be removed from the cartridge mounting portion. The adaptor may remain in the cartridge mounting portion. A new ink cartridge may be mounted to the cartridge mounting portion. When the ink cartridge is replaced, the first contact of the adaptor may remain connected to a contact of the cartridge mounting portion. Wear of the contact of the cartridge mounting portion may be reduced. When the ink cartridge is replaced, the electrical interface may be replaced. Thus, information may be renewed or updated.

According to another embodiment of the invention, an adaptor comprises a main body comprising a first contact disposed on a particular surface facing a particular direction, where is exposed to exterior of the main body, a second contact disposed on a further surface facing a further direction which is different from the particular direction, wherein the second contact is electrically connected to the first contact.

The ink cartridge may be replaced, with the adaptor remaining in the cartridge mounting portion. Accordingly, wear of the contact of the cartridge mounting portion may be reduced. The ink cartridge may comprise an electrical interface. Therefore, information may be renewed or updated when the ink cartridge is replaced.

Other objects, features, and advantages will be apparent to persons of ordinary skill in the art from the following detailed description of embodiments of the invention and the accompanying drawings.

BRIEF DESCRIPTION OF THE DRAWINGS

For a more complete understanding of the present disclosure, needs satisfied thereby, and the objects, features, and advantages thereof, reference now is made to the following description taken in connection with the accompanying drawings.

DETAILED DESCRIPTION OF EMBODIMENTS OF THE INVENTION

Figure 1:
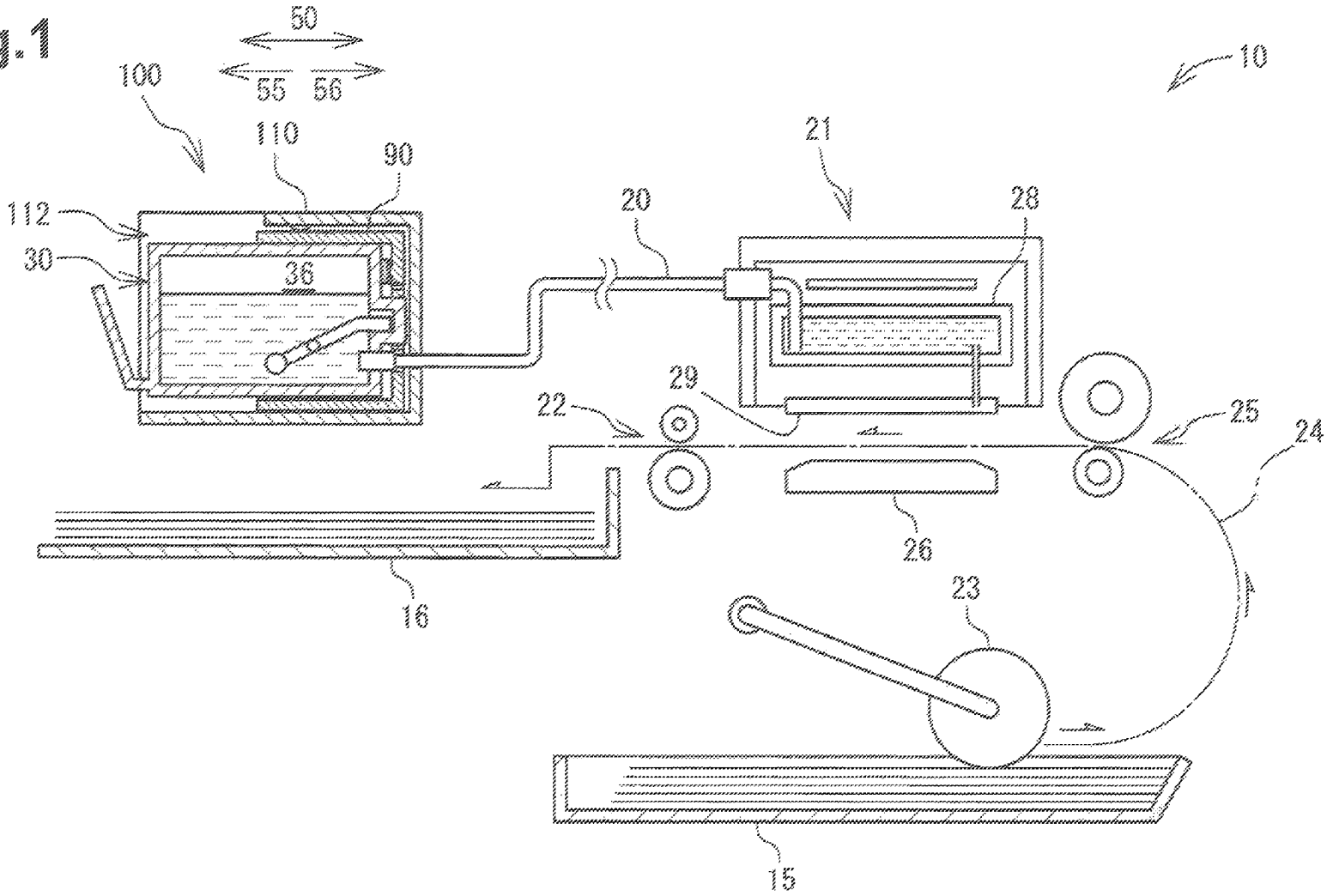
FIG. 1 is a schematic side view of a printer according to an embodiment of the present invention.

Example embodiments are described in detail herein with reference to the accompanying drawings, like reference numerals being used for like corresponding parts in the various drawings.

Referring to FIG. 1, a printer 10, e.g., an inkjet recording apparatus, may be configured to record an image by selectively ejecting ink droplets onto a recording sheet. The printer 10 may comprise a recording head 21 and an ink supply device 100. The ink supply device 100 may comprise a cartridge mounting portion 110. The cartridge mounting portion 110 may be configured to receive an ink cartridge 30 and an adaptor 90. The cartridge mounting portion 110 may have an opening 112 formed therethrough. The ink cartridge 30 and the adaptor 90 may be selectively inserted into or removed from the cartridge mounting portion 110 via the opening 112. The ink cartridge 30 and the adaptor 90 may correspond to an ink containing device.

The ink cartridge 30 may be configured to store ink for use in the printer 10. When the ink cartridge 30 is installed in the cartridge mounting portion 110, the ink cartridge 30 may be in fluid communication with the recording head 21 via a flexible tube 20. The flexible tube 20 may be connected to the cartridge mounting portion 110 at one end and to the recording head 21 at the other end. A sub-tank 28 may be disposed in the recording head 21. The sub-tank 28 may be configured to temporarily store ink supplied from the ink cartridge 30 via the flexible tube 20 and to supply ink to nozzles 29 of the recording head 21. The recording head 21 may be configured to selectively eject ink from the nozzles 29.

Recording sheets may be picked up one at a time from a sheet tray 15 by a pick-up roller 23 and conveyed to a conveying path 24. The recording sheet may be conveyed by conveying rollers 25 onto a platen 26. The recording head 21 may selectively eject ink onto the recording sheet conveyed over the platen 26. Thus, an image may be recorded onto the recording sheet. The recording sheet conveyed past the platen 26 may be output by output rollers 22 onto an output tray 16 positioned on the most downstream side of the conveying path 24 in a sheet conveying direction.

The ink cartridge 30 may be inserted into and removed from the cartridge mounting portion 110 in an insertion/removal direction 50, e.g., substantially a horizontal direction. More specifically, the ink cartridge 30 may be inserted into the cartridge mounting portion 110 in an insertion direction 56 and removed from the cartridge mounting portion 110 in a removal direction 55.

Figure 2:
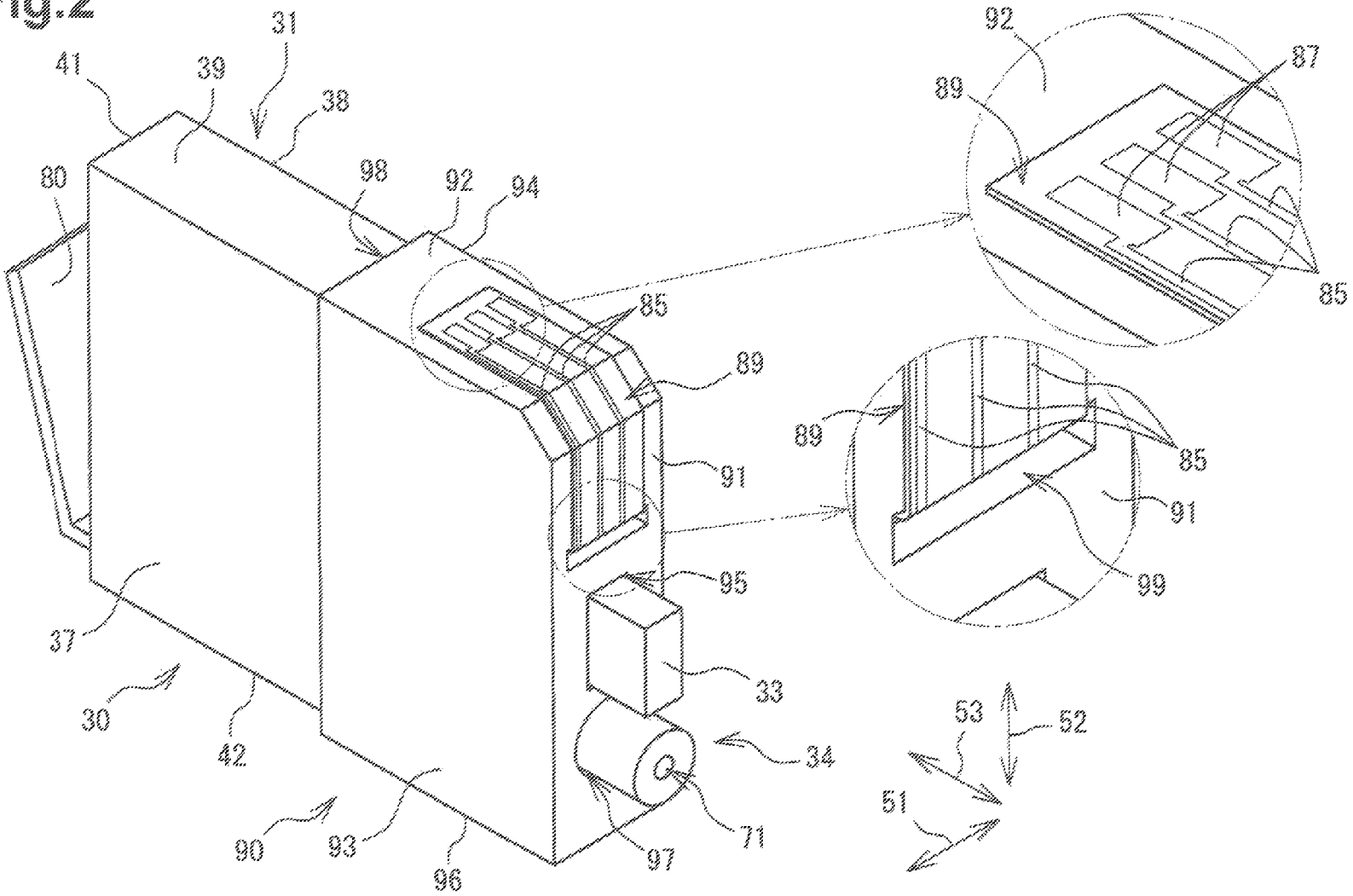
FIG. 2 is a perspective view of an ink cartridge to which an adaptor is attached according to an embodiment of the present invention.
Figure 3:
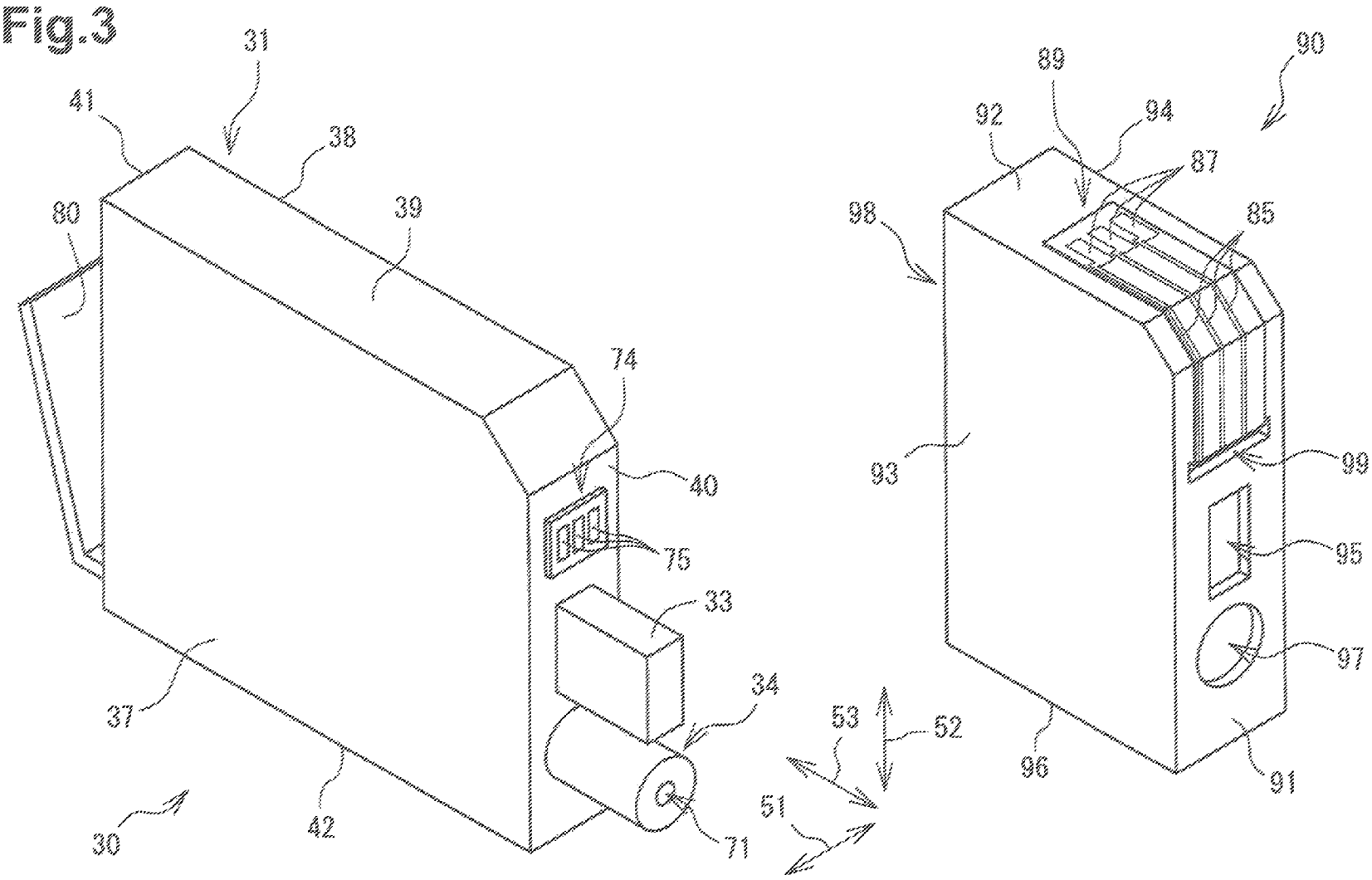
FIG. 3 is a perspective view of the ink cartridge of FIG. 2 with the adaptor removed, according to an embodiment of the present invention.

Referring to FIGS. 2 and 3, the ink cartridge 30 may comprise a container configured to store ink therein. The ink cartridge 30 may comprise a main body 31 comprising an ink chamber 36 (in FIGS. 1 and 5) within the main body 31. The ink chamber 36 may be configured to store ink therein. In another embodiment, the ink chamber 36 may be defined by a member other than the main body 31.

The main body 31 may have a depth in a depth direction 53, e.g., substantially parallel to the insertion/removal direction 50; a width in a width direction 51; and a height in a height direction 52. The width may be less than each of the height and the depth. The height direction 52, e.g., a vertical direction, may be parallel to a direction of gravity.

The main body 31 may comprise a front wall 40, and a rear wall 41 positioned opposite the front wall 40 in the insertion/removal direction 50. In other words, the front wall 40 may face the depth direction 53 and the rear wall 41 may be a distance away from the front wall 40 along the depth direction 53. When the ink cartridge 30 is inserted into the cartridge mounting portion 110, the front wall 40 may face forward in the insertion direction. 56 and the rear wall 41 may face rearward in the insertion direction 56. The front wall 40 and the rear wall 41 may extend along the height direction 52. The ink cartridge 30 also may comprise an upper wall 39 and a bottom wall 42 opposite the upper wall 39 in the height direction 52. The upper wall 39 and the bottom wall 42 may extend along the depth direction 53, e.g., a front-rear direction, perpendicular to the front wall 40 and the rear wall 41. The upper wall 39 may be connected to the upper end of the front wall 40 at one end and connected to the upper end of the rear wall 41 at the other end. The bottom wall 42 may be connected to the lower end of the front wall 40 at one end and connected to the lower end of the rear wall 41 at the other end. The ink cartridge 30 may further comprise side walls 37 and 38 that may be separated from each other in the width direction 51, e.g., a lateral direction, and may connect to ends of the upper wall 39, the front wall 40, the rear wall 41 and the bottom wall 42. The adaptor 90 may be configured to attach to the ink cartridge 30 on the side of the front wall 40.

In the example embodiment, a front face of the ink cartridge 30 defined by an outer or exterior face of the front wall 40 may be perpendicular to the insertion direction 56 of the ink cartridge 30. In the example embodiment, a front face of the ink cartridge 30 defined by an outer or exterior face of the front wall 40 may extend as one flat face continued from the upper wall 39 to the bottom wall 42. In another embodiment, the front wall 40 may be uneven and may have a plurality of faces. In this case, a front face of the ink cartridge 30 may be defined by an outer or exterior face of the front wall 40 that faces forward in the insertion direction 56.

The ink cartridge 30 may be inserted into and removed from the cartridge mounting portion 110 in the insertion/removal direction 50, in an orientation depicted in FIGS. 2 and 3, e.g., with the upper wall 39 thereof facing upward and the bottom wall 42 thereof facing downward. In another embodiment, the ink cartridge 30 may be inserted into and removed from the cartridge mounting portion 110 along the direction of gravity or a direction perpendicular to the horizontal direction and the direction of gravity. For example, when the ink cartridge 30 is inserted into and removed from the cartridge mounting portion 110 along the direction of gravity, the front wall 40 of the ink cartridge 30 may face downward.

Figure 6:
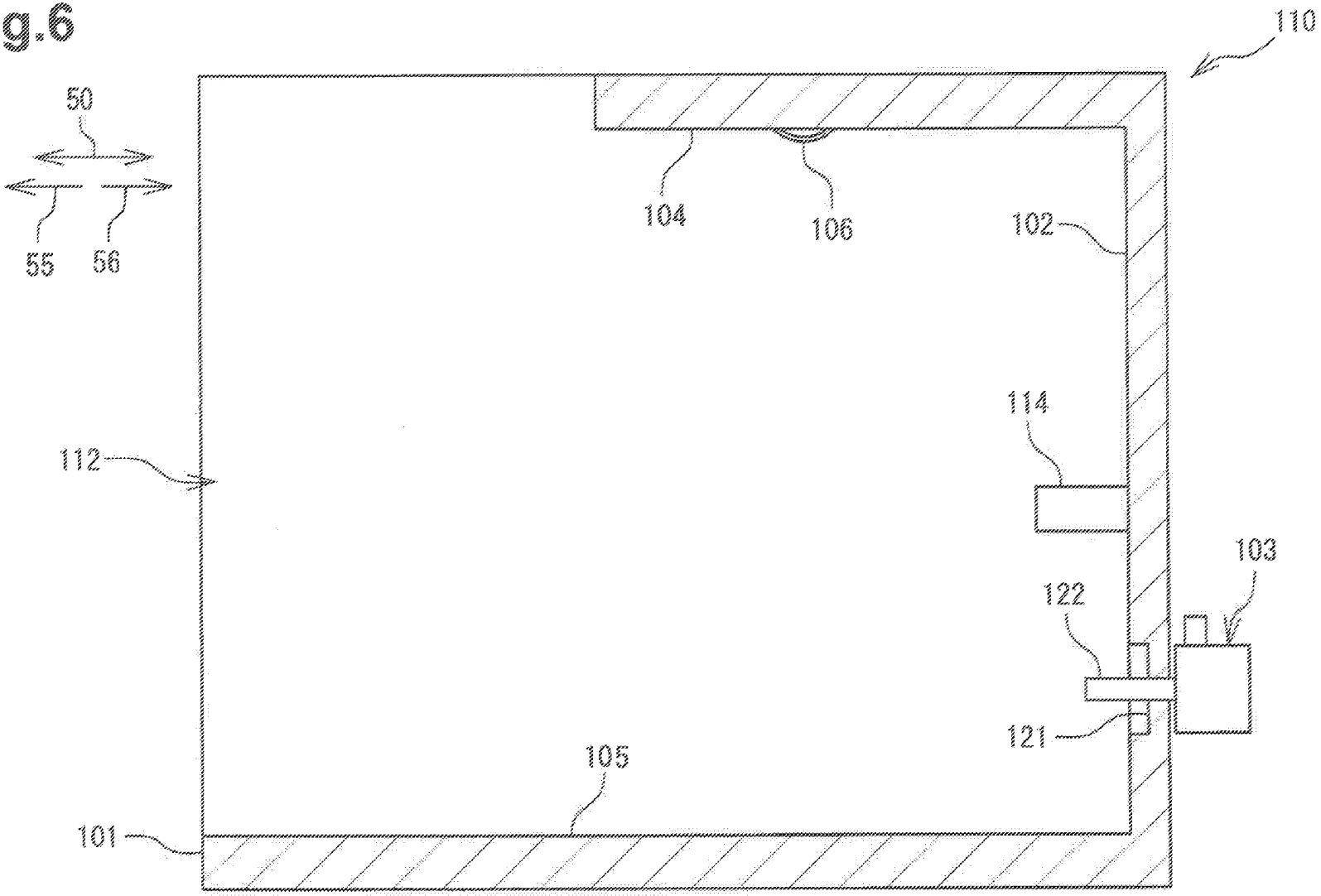
FIG. 6 is a cross-sectional view of a cartridge mounting portion according to an embodiment of the present invention.

Referring to FIGS. 2 and 3, the main body 31 may comprise a residual ink indicator 33 positioned at a middle portion of the front wall 40 of the main body 31 in the height direction 52. The residual ink indicator 33 may have an open-box shape with an open end. The residual ink indicator 33 may be configured to be in liquid communication with the ink chamber 36 via the open end. The residual ink indicator 33 may comprise a left wall and a right wall each comprising translucent resin configured to allow light to pass therethrough. The light, e.g., infrared light, may be emitted in a direction perpendicular to the insertion/removal direction 50, e.g., the width direction 51, from an optical sensor 114, as shown in FIG. 6, that may be positioned at the cartridge mounting portion 110. The residual ink indicator 33 may further comprise a translucent front, upper and bottom walls. The walls of the residual ink indicator 33 may be configured to allow light to pass therethrough in the width direction 51. The residual ink indicator 33 may be exposed via an opening 95 formed in the adaptor 90 when the adaptor 90 attaches to the ink cartridge 30. In another embodiment, the light emitted from the optical sensor 114 may be visible light. A space between the pair of the left and right walls of the residual ink indicator 33 may be hollow to store ink therein.

Figure 5:
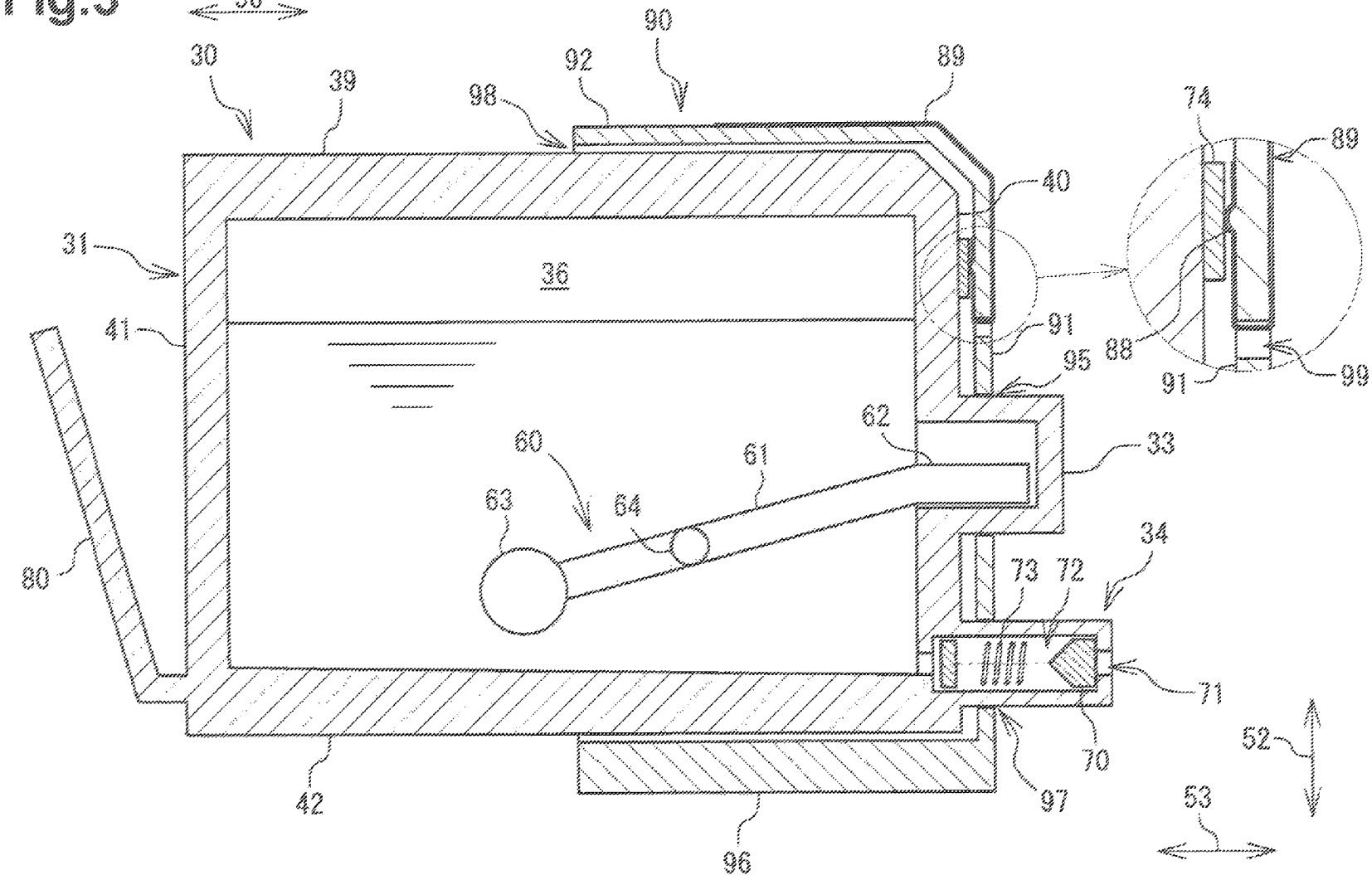
FIG. 5 is a cross-sectional view of the ink cartridge and the adaptor according to an embodiment of the present invention.

Referring to FIG. 5, the residual ink indicator 33 may comprise a sensor arm 60 that may comprise a plate-shaped arm body 61, a plate-shaped indicator portion 62 disposed at an end of the arm body 61, and a float portion 63 disposed at the other end of the arm body 61. The indicator portion 62 may be located between the left and right walls of the residual ink indicator 33. The sensor arm 60 may be pivotally supported by a support shaft 64 extending in the width direction 51 in the ink chamber 36. The sensor arm 60 may be configured to pivot in accordance with an amount of ink in the ink chamber 36. The indicator portion 62 may move between a lower position in which the indicator portion 62 is located at the lower position in the direction of gravity in the residual ink indicator 33 and an upper position in which the indicator portion 62 is located at the upper position in the direction of gravity in the residual ink indicator 33, according to the residual amount of ink in the ink chamber 36. More specifically, when an amount of ink in the ink chamber 36 is equal to or greater than a predetermined amount, the indicator portion 62 may be placed in the lower position. When ink is used and an amount of ink in the ink chamber 36 is less than the predetermined amount, the indicator portion 62 may be placed in the upper position. FIG. 5 may depict a state where a predetermined amount or more of ink may be present, and the indicator portion 62 is placed in the lower position.

When the ink cartridge 30 is mounted to the cartridge mounting portion 110, the residual ink indicator 33 may allow a predetermined amount or more of the infrared light emitted from the optical sensor 114 to pass through in a direction perpendicular to the insertion/removal direction 50, e.g., the width direction 51, or may block or attenuate the light to an amount less than the predetermined amount, depending on the amount of ink stored in ink chamber 36. When the indicator portion 62 is in the upper position, the residual ink indicator 33 may allow the light to pass therethrough. When the indicator portion 62 is in the lower position, the residual ink indicator 33 may block or attenuate the light. Based on whether the residual ink indicator 33 allows the light to pass therethrough or blocks or attenuates the light, it may be determined whether the residual ink amount in ink chamber 36 is less than the predetermined amount.

The main body 31 may comprise an ink outlet portion 34 positioned at a lower portion of the front wall 40 of the main body 31 below the residual ink indicator 33. The ink outlet portion 34 may be opposite to an IC substrate 74 disposed on the front wall 40 in the height direction 52 with respect to the residual ink indicator 33. In other words, the ink outlet portion 34 may be disposed further away from the upper wall 39 of the ink cartridge 30 than the IC substrate 74 in the height direction 52. The ink outlet portion 34 may have a cylindrical shape. The ink outlet portion 34 may be protruded from the exterior of the surface of the front wall 40 along the depth direction 53. The projecting end of the ink outlet portion 34 may be provided with an ink outlet port 71. The ink outlet port 71 of the ink outlet portion 34 may be exposed via an opening 97 of the adaptor 90 when the adaptor 90 attaches to the ink cartridge 30. The insertion direction 56 may correspond to a direction in which the ink outlet portion 34 may protrude.

Referring to FIG. 5, the ink outlet portion 34 may have an ink channel 72 formed therein. The ink channel 72 may extend in the insertion/removal direction 50 from the ink outlet port 71 to the ink chamber 36 via an internal space of the ink outlet portion 34. An ink outlet valve 70 may be disposed in the ink channel 72 and configured to selectively open and close the ink outlet port 71. The ink outlet valve 70 may be urged by a coil spring 73 toward the ink outlet port 71. When the ink cartridge 30 is mounted to the cartridge mounting portion 110, a hollow tube 122, as depicted in FIG. 6, provided in the cartridge mounting portion 110 may enter the ink outlet port 71, to move the ink outlet valve 70 away from the ink outlet port 71 against the urging force of the coil spring 73. The hollow tube 122 may have an ink introduction port formed at one end thereof on a portion of an outer peripheral wall of the hollow tube 122. Thus, ink may be directed from the ink chamber 36 into the hollow tube 122, through the ink channel 72.

In another embodiment, the ink outlet port 71 may be sealed with a film. When the ink cartridge 30 is mounted to the cartridge mounting portion 110, the hollow tube 122 may penetrate the film to open the ink outlet port 71. In another embodiment, the main body 31 may have an air communication opening to bring negative pressure in the ink chamber 36 to the atmospheric pressure.

Referring to FIGS. 3 and 5, the IC substrate 74 may be disposed on an upper portion of the front wall 40 of the main body 31 above the residual ink indicator 33. The IC substrate 74 may be opposite to the ink outlet portion 34 disposed on the front wall 40 in the height direction 52 with respect to the residual ink indicator 33. In other words, the IC substrate 74 may be disposed on the front wall 40 on a side closer to the upper wall 39 than the ink outlet portion 34. The IC substrate 74 may be electrically connected with a contact 106, as depicted in FIG. 6, disposed on the cartridge mounting portion 110, via the adaptor 90.

The IC substrate 74 may have a thin plate shape. The IC substrate 74 may comprise an integrated circuit ("IC") comprising a memory and three electrodes 75, e.g., a HOT electrode, a GND electrode, and a signal electrode. The IC may be a semiconductor integrated circuit. The memory may be configured to store data of information about the ink cartridge 30, e.g., ink color and a manufacturer, that may be unnecessary to be renewed or updated when the ink cartridge 30 is replaced. The memory may be coupled to the electrode 75 such that the memory is electrically connected to the electrode 75. The data stored in the IC may be read out by the printer 10.

Figure 7:
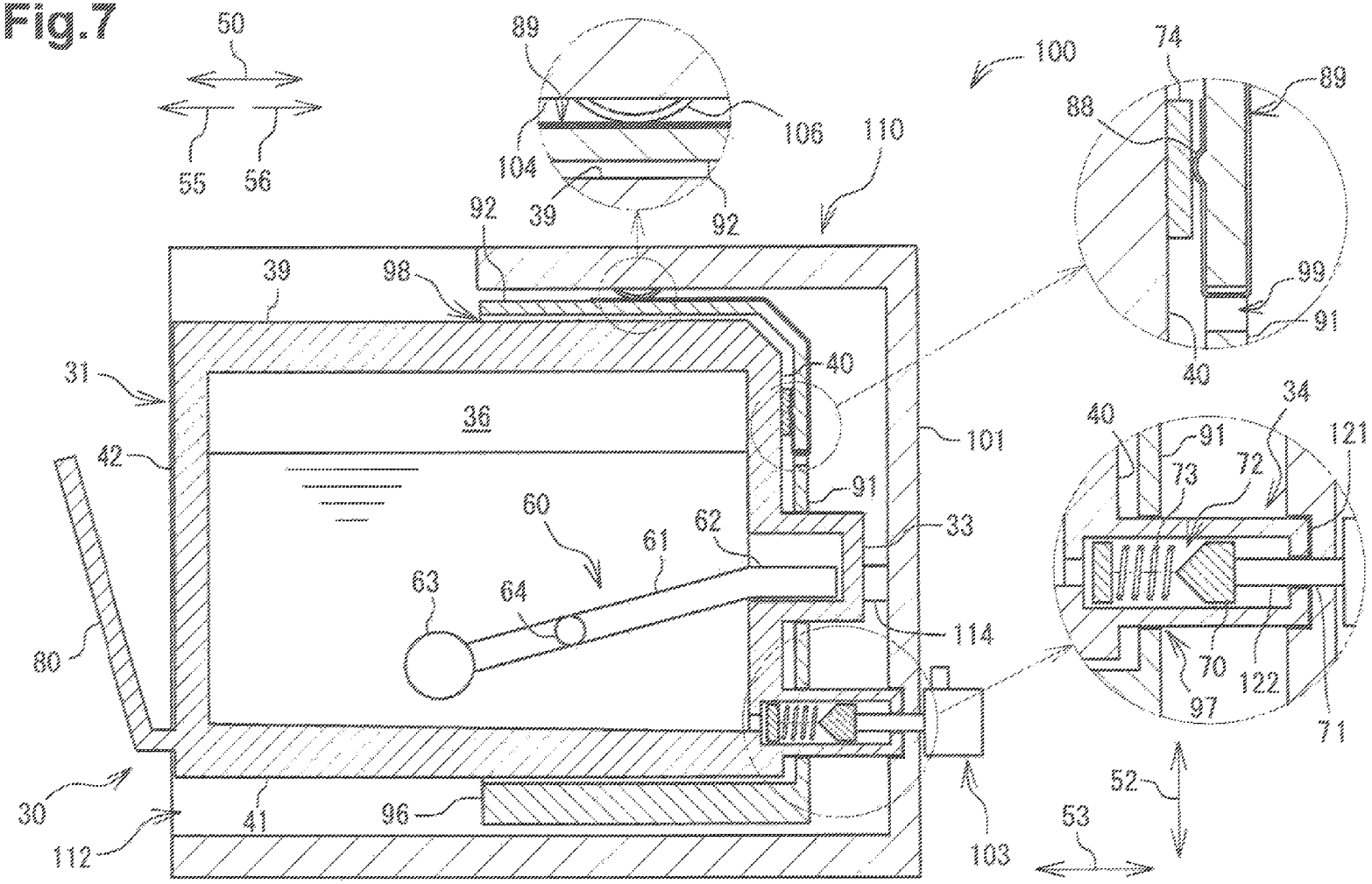
FIG. 7 is a cross-sectional view of the ink cartridge and the adaptor mounted on the cartridge mounting portion according to an embodiment of the present invention.

The electrodes 75 may be electrically connected with the IC. The electrodes 75 may be elongated vertically in the height direction 52 and may be separated from each other in the width direction 51. The electrode 75 may be exposed on a surface of the IC substrate 74 facing on the insertion direction 56 along the front surface 40 so as to allow electrical access. In other words, the electrode 75 may be exposed to be accessible from a front side of the main body 31 in the removal direction 55. Referring to FIG. 7, when the adaptor 90 and the ink cartridge 30 are mounted to the cartridge mounting portion 110, the IC substrate 74 may be electrically connected with the contacts 106 via the adaptor 90.

A handle 80 may be provided on the rear wall 41 of the main body 31. The handle 80 may have a plate shape extending upward and rearward from a portion near the lower end of the rear wall 41. The shape and position of the handle 80 might not be limited to the above shape and position, but may have any shape and position that may make the main body 31 easily removed from the cartridge mounting portion 110 when a user replaces the ink cartridge 30.

Referring to FIGS. 2-5, the adaptor 90 may have a relatively thin open box-shape with an open end. The adaptor 90 may be configured to cover at least a portion of the exterior surface of the main body 31 comprising the front wall 40, the side walls 37 and 38, the upper wall 39, and the bottom wall 42. The adaptor 90 may have such a width and height to cover a whole area of the front wall 40 of the main body 31 and such a depth to cover a portion of the side walls 37, 38, the upper wall 39, and the bottom wall 42. In other words, the adaptor 90 may have a box shape having a width and height slightly wider and higher than those of the main body 31 and a depth shorter than that of the main body 31.

The adaptor 90 may comprise a front wall 91, an upper wall 92 facing in the height direction 52, side walls 93 and 94, and a bottom wall 96 opposite the front wall 40, the upper wall 39, the side walls 37 and 38, and the bottom wall 42 of the main body 31, respectively, when the ink cartridge 30 and the adaptor 90 are in the attached state. The front wall 91 may be perpendicular to the upper wall 39. The adaptor 90 may have an opening 98 opposite the front wall 91 in the depth direction 53. The main body 31 may attach to the adaptor 90 via the opening 98. An outer or exterior surface of the upper wall 92 may correspond to an upper surface.

The adaptor 90 may be inserted into and removed from the cartridge mounting portion 110 in the insertion/removal direction 50 in an orientation depicted in FIGS. 2-5, e.g., with the upper wall 92 thereof facing upward and the bottom wall 96 thereof facing downward.

The adaptor 90 may have the opening 95 formed at generally a middle portion of the front wall 91 in the height direction 52 through the front wall 91 in the depth direction 53. When the main body 31 of the ink cartridge 30 is inserted into the adaptor 90, the residual ink indicator 33 of the main body 31 may be exposed via the opening 95. The position, size and shape of the opening 95 may be formed in correspondence with those of the residual ink indicator 33.

The adaptor 90 also may have the opening 97 formed at a lower portion of the front wall 91 in the height direction 52 through the front wall 91 in the depth direction 53. The opening 97 may be disposed below the opening 95 in the height direction 52. When the main body 31 of the ink cartridge 30 is inserted into the adaptor 90, the ink outlet portion 34 of the main body 31 may be exposed via the opening 97. The position, size and shape of the opening 97 may be formed in correspondence with those of the ink outlet portion 34.

The adaptor 90 also may have an opening 99 formed at an upper portion of the front wall 91 in the height direction 52 through the front wall 91 in the depth direction 53. A flexible printed circuit (FPC) 89 disposed on the adaptor 90 may be inserted into the opening 99. The size and shape of the opening 99 may be formed in correspondence with those of the FPC 89.

Referring to FIGS. 2-5, the FPC 89 may be a printed circuit having flexibility. The FPC 89 may have a thin belt-like shape. The FPC 89 may comprise areas 87 disposed at an end portion thereof and areas 88 disposed at an opposite end portion thereof. The areas 87 and 88 may be configured to allow electrical access. The FPC 89 may electrically connect the areas 87 and 88. The areas 87 disposed at an end portion of the FPC 89 may be exposed on the exterior surface of the upper wall 92 of the adaptor 90. The areas 87 may comprise, for example, three, areas in correspondence with the three electrodes 75 of the IC substrate 74 disposed on the ink cartridge 30. The three areas 87 may be electrically independent from each other. The area 87 may correspond to a first contact. A plane extending along an outer or exterior surface of the upper wall 92, on which the areas 87 may be disposed, may correspond to a first virtual plane.

The areas 87 of the FPC 89 disposed at an end portion thereof and the areas 88 disposed on an opposite end portion of the FPC 89 may be electrically connected with each other by respective wirings 85. Each wiring 85 may extend along a longitudinal direction of the FPC 89 and may linearly extend along the depth direction 53 on the exterior surface of the upper wall 92 of the adaptor 90. The wirings 85 may be separated from each other in the width direction 51. The wirings 85 may be deviated from the respective areas 87 in the width direction 51. In other words, the wirings 85 and the corresponding areas 87 might not align with each other in the width direction 51. For example, each of the respective areas 87 of the FPC 89 and the wirings 85 may be offset in a width direction 51. That is, the areas 87 may not be arranged on an extension of the respective wirings 85 in the depth direction 53.

The FPC 89 may hang down from the upper wall 92 of the adaptor 90 to the front wall 91 along the exterior surface of the adaptor 90. An end portion of the FPC 89 may be inserted from the exterior surface of the front wall 91 into the opening 99, to extend upward along the interior surface of the front wall 91 to a position corresponding to the IC substrate 74 of the ink cartridge 30.

Figure 4B:
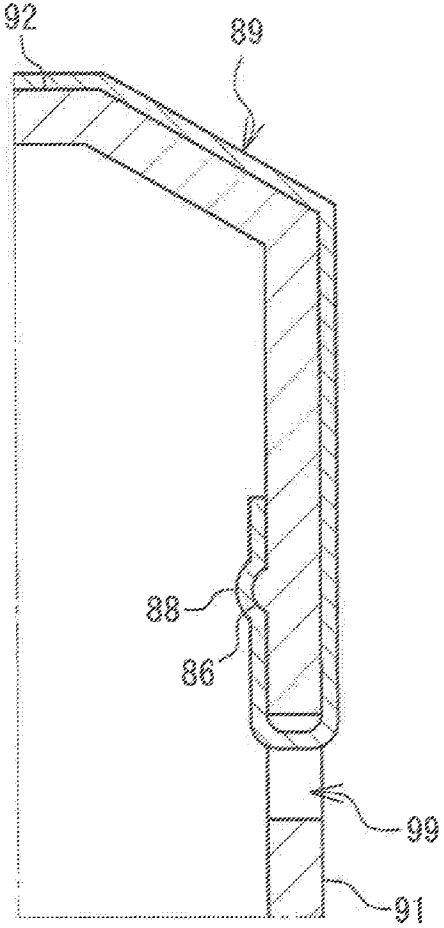
FIG. 4B is a partial cross-sectional view of the adaptor according to an embodiment of the present invention.
Figure 4A:
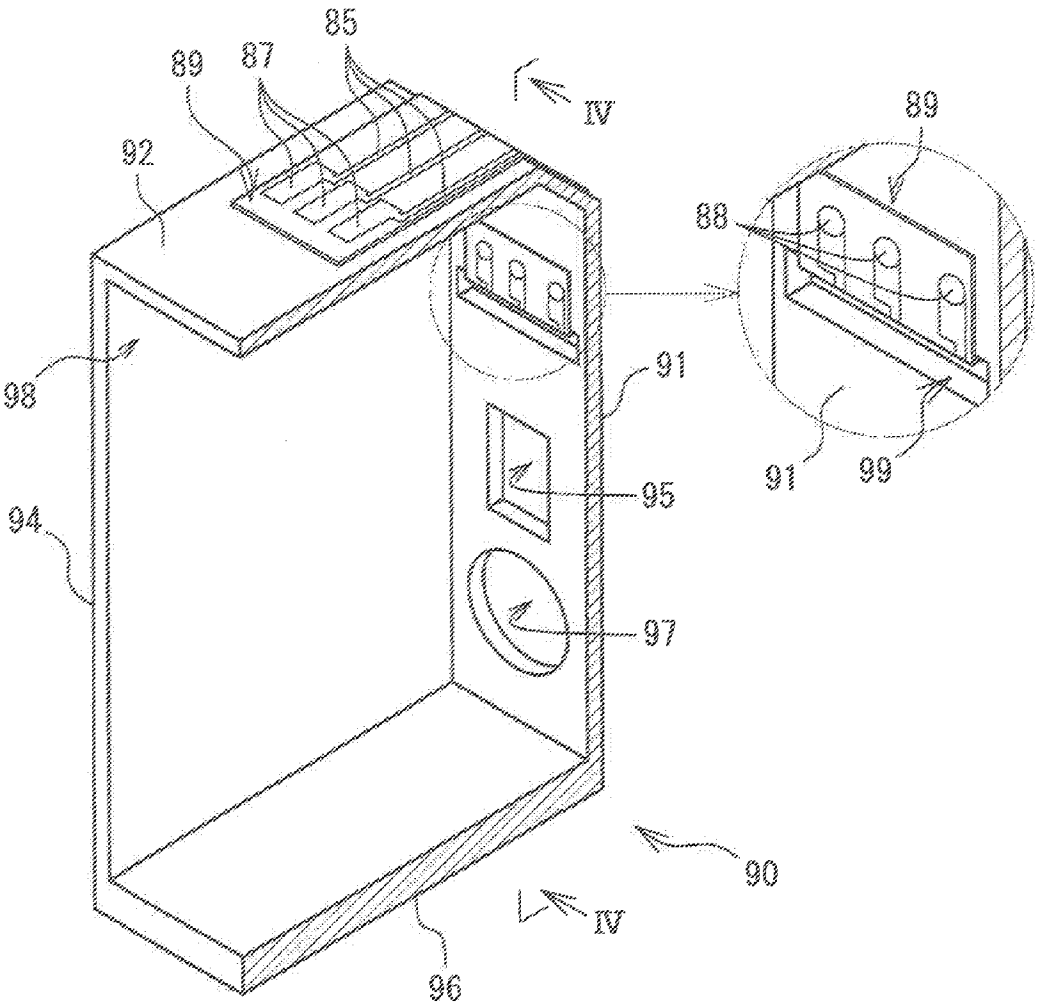
FIG. 4A is a cross-sectional perspective view of the adaptor according to an embodiment of the present invention, wherein an interior of the adaptor is depicted.

Referring to FIG. 4, the front wall 91 may comprise e.g., three, swelling portions 86 at the interior surface thereof, in correspondence with the electrodes 75 of the IC substrate 74. The swelling portion 86 may have a dome shape protruding toward the opening 98. The swelling portion 86 may have elasticity. The areas 88 disposed at the opposite end of the FTC 89 may be disposed to cover respective swelling portions 86. Accordingly, each area 88 may protrude further toward the opening 98 than the interior surface of the front wall 91. The areas 88 may correspond to a second contact. A plane extending along an inner or interior surface of the front wall 91, on which the areas 88 may be disposed, may correspond to a second virtual plane. The second virtual plane may be perpendicular to the first virtual plane. The electrode 75 may be a first distance away from the ink outlet portion 71 in height direction 52. The first contact 87 may be a second distance away from the ink outlet portion 71 in the height direction 52 when the ink cartridge 30 and the adaptor 90 are in the attached state, and the second distance may be greater than the first distance. The electrode 75 may face a third direction, and the second contact 87 may face the removal direction when the ink cartridge 30 and the adaptor 90 are in the attached state.

Referring to FIG. 1, the printer 10 may comprise the recording head 21 and the ink supply device 100 configured to supply ink to the recording head 21. The ink supply device 100 may comprise the cartridge mounting portion 110 configured to receive the ink cartridge 30 and the adaptor 90. In FIG. 1, the ink cartridge 30 and the adaptor 90 may be mounted to the cartridge mounting portion 110.

Referring to FIG. 6, the cartridge mounting portion 110 may comprise a case 101 serving as a housing. The case 101 may have the opening 112 on a front side of the printer 10. The ink cartridge 30 and the adaptor 90 may be selectively inserted into and removed from the case 101 via the opening 112. The case 101 may be configured to accommodate a plurality of, e.g., four, ink cartridges 30 and a plurality of, e.g., four, adaptors 90. Each ink cartridge 30 and the adaptor 90 may correspond to one of a plurality of colors, e.g., cyan, magenta, yellow, and black. FIG. 6 may depict a space of the case 101 in which one ink cartridge 30 and one adaptor 90 may be accommodated.

Referring to FIG. 6, the case 101 may have an end interior surface 102 at a side opposite from the opening 112 in the insertion/removal direction 50, an upper interior surface 104 that may be connected to an upper end of the end interior surface 102 in the height direction 52, and a bottom interior surface 105 at a side opposite from the upper interior surface 104 in the height direction 52. A connecting portion 103 may be disposed at a tower portion of the end interior surface 102 in correspondence with each ink outlet portion 34 of the ink cartridges 30 when the ink cartridges 30 are mounted to the case 101.

The connecting portion 103 may comprise the hollow tube 122 and a holding portion 121. The hollow tube 122 may comprise resin and have a tubular shape. An end of the hollow tube 122 may have the ink introduction port. The hollow tube 122 may be connected to the ink tube 20 at an exterior surface opposite from the end interior surface 102 of the case 101. Each ink tube 20 connected to each hollow tube 122 at the exterior surface opposite from the end interior surface 102 may be connected to the recording head 21 of the printer 10 so as to circulate the ink.

The holding portion 121 may have a cylindrical shape. The hollow tube 122 may be disposed at a middle portion of the holding portion 121. Referring to FIG. 7, when the ink cartridge 30 is mounted to the cartridge mounting portion 110, the ink outlet portion 34 may be inserted into the cylindrical portion of the holding portion 121. The outer peripheral surface of the ink outlet portion 34 may contact the inner peripheral surface of the cylindrical portion of the holding portion 121. When the ink outlet portion 34 is inserted into the holding portion 121, the hollow tube 122 may be inserted into the ink outlet port 71 of the ink outlet portion 34. Accordingly, ink stored in the ink chamber 36 may flow outward. Ink flowing outward from the ink chamber 36 may flow into the hollow tube 122 via the ink introduction port.

Referring to FIG. 6, an optical sensor 114 may be disposed at the end interior surface 102 of the case 101 above the connecting portion 103 in the direction of gravity. The optical sensor 114 may comprise a tight-emitting element, e.g., a light-emitting diode (LED), and a light-receiving element, e.g., a phototransistor. Each of the light-emitting element and the light-receiving element may be surrounded by a housing. The external shape of the optical sensor 114 formed by the housing may be a horseshoe shape. The light-emitting element and the light-receiving element may be disposed to face each other with a predetermined distance therebetween in the horseshoe-shaped housing in the horizontal direction perpendicular to the insertion/removal direction 50, e.g., width direction 51. The light-emitting element may be configured to emit light through the housing in one direction, e.g., a horizontal direction perpendicular to the insertion/removal direction 50, e.g., width direction 51. The light-receiving element may be configured to receive the tight emitted from the tight-emitting element toward the housing in one direction. The residual ink indicator 33 of the ink cartridge 30 may enter a space between the light-emitting element and the light-receiving element when the ink cartridge 30 is mounted to the cartridge mounting portion 110. When the residual ink indicator 33 enters the optical path of the optical sensor 114, the optical sensor 114 may detect the light transmission amount changed due to the residual ink indicator 33.

Reaming to FIG. 6, the case 101 may comprise, e.g., three, contacts 106 disposed on the upper interior surface 104 of the case 101 at a position between the end interior surface 102 and the opening 112. The contacts 106 may be separated from each other in the width direction 51 perpendicular to the insertion/removal direction 50, to correspond to the respective areas 87 of the FPC 89. Each contact 106 may comprise a material having an electrical continuity and elasticity. Each contact 106 may be configured to elastically deform in an upward direction in the height direction 52.

Each contact 106 may be electrically connected to a controller via an electric circuit. The controller may comprise, for example, a central-processing unit ("(CPU"), a read-only memory ("ROM"), and a random-access memory ("RAM") and may be configured as a control device of the printer 10. The contact 106 may establish electrical connection with the electrode 75, e.g., the HOT electrode, via the FPC 89, to apply voltage Vc to the HOT electrode. Another contact 106 may establish electrical connection with the electrode 75, e.g., the GND electrode, via the FPC 89, to allow the GND electrode to establish a ground. The contacts 106 may establish electrical connection with the electrodes 75, e.g., the HOT electrode and the GND electrode, via the FPC 89, to supply power to the IC. The other contact 106 may establish electrical connection with the electrode 75, e.g., the signal electrode, via the FPC 89, to access data stored in the IC. A signal output to the electric circuit via the contacts 106 may be input to the controller. The contact 106 may correspond to a third contact.

For example, when a user first uses the printer 10, no ink cartridges 30 or the adaptors 90 may be mounted on the cartridge mounting portion 110. Before a user first mounts the ink cartridge 30 and the adaptor 90 to the cartridge mounting portion 110, the ink cartridge 30 and the adaptor 90 might not be attached to each other.

Referring to FIG. 2, the adaptor 90 may attach to the ink cartridge 30 on a side of the front wall 40. The ink cartridge 30 and the adaptor 90 may be inserted into the cartridge mounting portion 110. With the adaptor 90 attached to the ink cartridge 30, the ink outlet portion 34 may be exposed via the opening 97 of the adaptor 90, and the residual ink indicator 33 may be exposed via the opening 95 of the adaptor 90. The electrodes 75 of the IC substrate 74 disposed on the ink cartridge 30 may contact the respective areas 88 of the FPC 89 to establish electrical connection. When the main body 31 is inserted into the cartridge mounting portion 110, the adaptor 90 may be inserted into the cartridge mounting portion 110 together with the main body 31 while the adaptor 90 contacts the front wall 40 of the main body 31 of the ink cartridge 30.

While the ink cartridge 30 is mounted to the cartridge mounting portion 110, the residual ink indicator 33 may reach a detecting position of the optical sensor 114 where the light-emitting element and the light-receiving element may face each other and the light-receiving element may detect or receive the light. Thus, the optical sensor 114 may detect the indicator portion 62 of the sensor arm 60.

Referring to FIG. 7, while the ink cartridge 30 and the adaptor 90 are being mounted to the cartridge mounting portion 110, the ink outlet portion 34 exposed outward from the adaptor 90 may contact the holding portion 121, and the hollow tube 122 may enter the ink outlet port 71 of the ink outlet portion 34. As the main body 31 is further moved in the insertion direction 56 with the hollow tube 122 contacting the valve 70 through the ink outlet port 71, the hollow tube 122 may push the valve 70 to move away from the ink outlet port 71. As the ink outlet portion 34 is inserted into the holding portion 121, and the hollow tube 122 is inserted into the ink outlet port 71, the main body 31 of the ink cartridge 30 may be placed in a predetermined portion of the case 101. Ink may flow from the ink chamber 36 to the hollow tube 122 via the ink introduction port.

When the ink cartridge 30 and the adaptor 90 are mounted to the cartridge mounting portion 110, the position of each area 87 of the FPC 89 on the upper wall 92 of the adaptor 90 may overlap the respective contact 106 of the cartridge mounting portion 110 in the height direction 52 when viewed from the depth direction 53. The adaptor 90 may elastically deform the contacts 106 to push up the contacts 106 when the adaptor 90 attaches to the cartridge mounting portion 110. When the adaptor 90 is inserted into the cartridge mounting portion 110 in the insertion direction 56, the contacts 106 may slide on portions of the upper wall 92 corresponding to the respective areas 87 in the width direction 51. Because the wirings 85 and the corresponding areas 87 might not align with each other in the width direction 51, the contacts 106 might not slide on the respective wirings 85.

When the adaptor 90 is in the attached state with the cartridge mounting portion 110, the contacts 106 urged downward by an elastic restoring force may electrically contact the respective areas 87 of the FPC 89 on the upper wall 92 of the adaptor 90, an that the contacts 106 may be electrically connected with the respective electrodes 75 of the IC substrate 74, via the FPC 89. Information read from the IC substrate 74 may be used to determine the color of ink stored in the ink cartridge 30 and its manufacturer. The color of ink in stored in the ink cartridge 30 and its manufacturer may be determined based on the information.

The ink cartridge 30 and the adaptor 90 may be positioned in the case 101, for example, with a protrusion disposed in an interior surface of the case 101. In the example embodiment, the ink cartridge 30 and the adaptor 90 attached to each other may be inserted into the cartridge mounting portion 110. In another embodiment, the ink cartridge 30 and the adaptor 90 may be separately inserted into the cartridge mounting portion 110, e.g., the adaptor 90 may be first inserted and then the ink cartridge 30 may be inserted into the cartridge mounting portion 110, and then the adaptor and the ink cartridge may be in the attached state.

When ink in the ink chamber 36 of the ink cartridge 30 is consumed, the ink cartridge 30 with depleted ink may be removed and a new ink cartridge 30 may be mounted. Thus, ink cartridge 30 with depleted ink may be replaced among the ink cartridges 30.

When the ink cartridge 30 is removed from the cartridge mounting portion 110, the handle 80 of the main body 31 may be pulled in the removal direction 55. Thus, the ink cartridge 30 may move in the removal direction 55. The ink cartridge 30 might not be engaged with the adaptor 90, so that the ink cartridge 30 may be selectively inserted into and removed from the adaptor 90 through the opening 98. As the handle 80 is pulled in the removal direction 55, the ink cartridge 30 may move relative to the adaptor 90 in the removal direction 55.

As the ink cartridge 30 is moved in the removal direction 55, the ink outlet portion 34 may pass through the opening 97 in the removal direction 55. The residual ink indicator 33 may move away from the detecting position of the optical sensor 114 in the removal direction 55.

Figure 8:
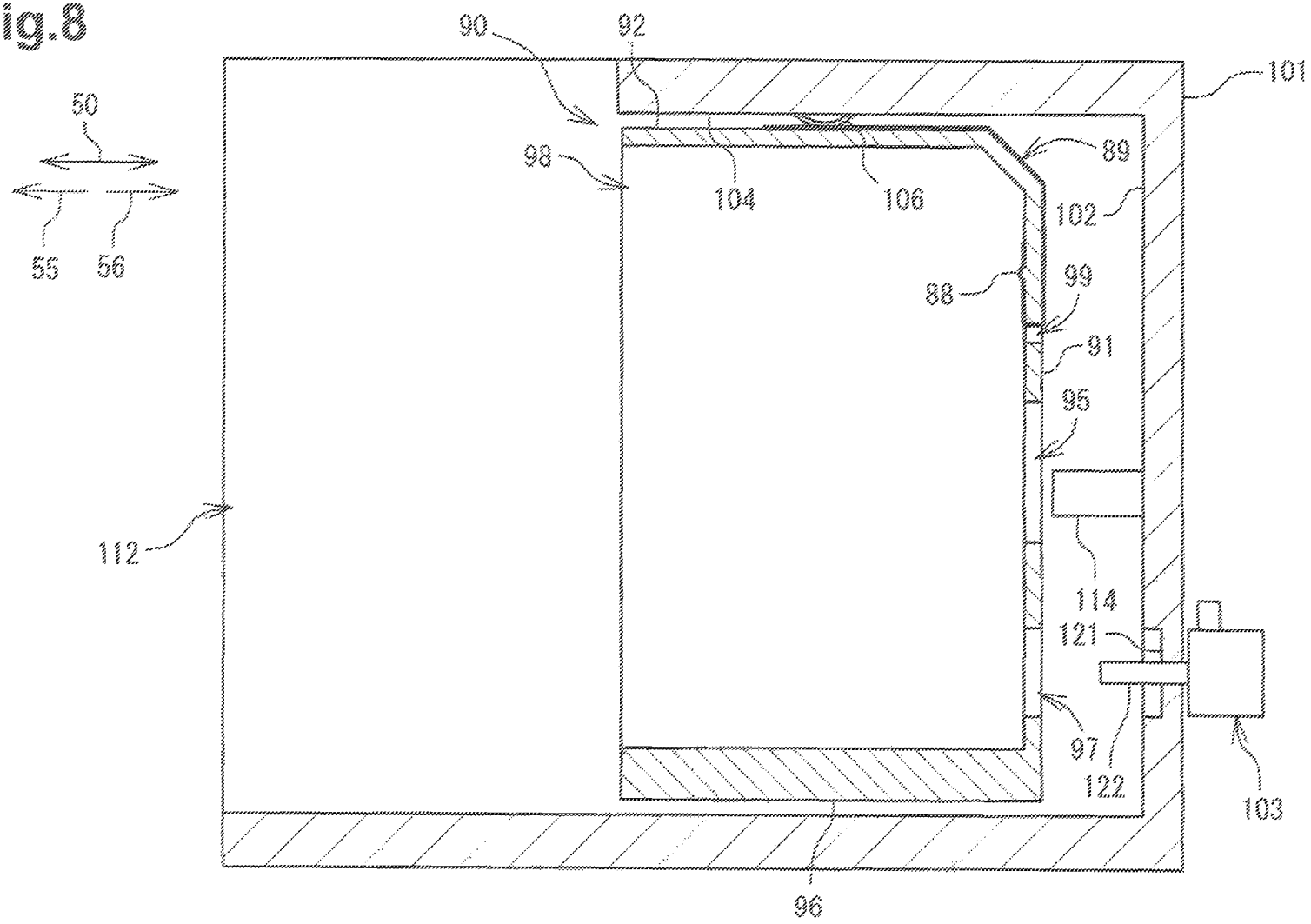
FIG. 8 is a cross-sectional view of the adaptor mounted on the cartridge mounting portion according to an embodiment of the present invention.

When the ink cartridge 30 is removed from the cartridge mounting portion 110, the adaptor 90 may remain in the cartridge mounting portion 110, as depicted in FIG. 8. Each area 87 of the FPC 89 may remain to be electrically connected with the respective contacts 106. As a new ink cartridge 30 is mounted to the cartridge mounting portion 110, the ink cartridge 30 may move in the insertion direction 56 toward the opening 98 of the adaptor 90 in the cartridge mounting portion 110. In the cartridge mounting portion 110, the ink cartridge 30 and the adaptor 90 may be attached to each other, such that the ink cartridge 30 and the adaptor 90 may be in the attached state.

While the ink cartridge 30 is being inserted into in the cartridge mounting portion 110 to attach the ink cartridge 30 to the adaptor 90, the residual ink indicator 33 may pass through the opening 95 of the adaptor 90, and may reach the detection position of the optical sensor 114. The optical sensor 114 may detect the indicator portion 62 of the sensor arm 60.

The ink outlet portion 34 passing through the opening 97 of the adaptor 90 may contact the holding portion 121. The hollow tube 122 may be inserted into the ink outlet port 71 of the ink outlet portion 34.

Each electrode 75 of the IC substrate 74 of the ink cartridge 30 may contact and electrically connect with the respective area 88 of the FPC 89 of the adaptor 90. Thus, the electrodes 75 may be electrically connected with the respective contacts 106 via the FPC 89.

In the example embodiment, the ink cartridge 30 may be replaced, with the adaptor 90 remaining in the cartridge mounting portion 110. Accordingly, wear of the contacts 106 of the cartridge mounting portion 110 may be reduced. The IC substrate 74 may be disposed on the main body 31 of the ink cartridge 30, so that information may be renewed or updated in association with the replacement of the ink cartridge 30.

The electrodes 75 of the IC substrate 74 and the contacts 106 of the cartridge mounting portion 110 may be electrically connected via the adaptor 90. Therefore, a direction in which the electrodes 75 of the IC substrate 74 may face and a plane at which the electrodes 75 may be disposed may differ from a direction in which the areas 87 that may be connected to the contacts 106 of the cartridge mounting portion 110 may face and a plane at which the areas 87 may be disposed, respectively.

The areas 87 may be disposed on the exterior surface of the upper wall 92 extending along the insertion/removal direction 50. When the adaptor 90 is inserted into the cartridge mounting portion 110, the contacts 106 may contact the respective areas 87 white sliding on the upper wall 92. Once the adaptor 90 has attached to the cartridge mounting portion 110, the adaptor 90 may remain in the cartridge mounting portion 110 and the ink cartridge 30 may be replaced. When the ink cartridge 30 is replaced, the areas 87 might not slide relative to the respective contacts 106 of the cartridge mounting portion 110. Therefore, wear of the contacts 106 may be reduced. The areas 88 may be disposed on the interior surface of the front wall 91 of the adaptor 90 perpendicular to the insertion/removal direction 50. Therefore, when the ink cartridge 30 is replaced with respect to the adaptor 90 remaining in the cartridge mounting portion 110, the areas 88 might not slide relative to the ink cartridge 30 but may contact the respective electrodes 75 when the ink cartridge 30 has attached to the adaptor 90. Therefore, wear of the areas 88 may be reduced. When the areas 88 are worn or damaged due to the contact between the electrodes 75 and the areas 88 while the ink cartridge 30 is replaced multiple times with respect to the adaptor 90, the adaptor 90 may be replaced with respect to the cartridge mounting portion 110.

The front wall 91 may comprise the swelling portions 86 at the interior surface thereof. The swelling portion 86 may have a dome shape protruding toward the opening 98. If the electrode 75 and the area 88 are configured to be electrically connected to each other by making a flat surface of the electrode 75 and a flat surface of the area 88 contact with each other, unevenness of the flatness of the electrode 75 or the area 88, or adherence of foreign matters to the flat surfaces may cause the electrode 75 and the area 88 to unstably contact with each other. In the example embodiment, the electrodes 75 may more readily contact the respective dome-shaped areas 88 than the interior surface of the front wall 91. Thus, the electrodes 75 and the areas 88 may reliably contact to electrically connect to each other.

As described above, the residual ink indicator 33 may comprise the sensor arm 60. In another embodiment, the residual ink indicator 33 might not comprise the sensor arm 60. The light-emitting element and the light-receiving element of the optical sensor 114 may oppose in a horizontal direction perpendicular to the insertion/removal direction 50, e.g., the width direction 51. The light emitted from the light-emitting element may pass in the horizontal direction perpendicular to the insertion/removal direction 50 and be received by the light-receiving element. When there is ink in the residual ink indicator 33, the residual ink indicator 33 may block or attenuate the light emitted from the light-emitting element. When there is no ink in the residual ink indicator 33, the residual ink indicator 33 may pass the light emitted from the light-emitting element by a predetermined amount or more. In another embodiment, the residual ink indicator 33 may comprise a flexible film. When there is ink in the residual ink indicator 33, the film may be expanded. As the film contacts a pivot lever, the lever may be placed at a position to block the light. When there is no ink in the residual ink indicator 33, the film may be contracted. The lever may pivotally move up or down so as to be located at a position where the light is not blocked. In another embodiment, the light emitted from the light-emitting element may be reflected on or in the residual ink indicator 33 so as not to reach the light-receiving element when there is ink in the residual ink indicator 33, and may be reflected on or in the residual ink indicator 33 so as to be received by the light-receiving element when there is no ink in the residual ink indicator 33. In another embodiment, the sensor arm 60 might not be used with the optical sensor 114. For example, the sensor arm 60 may be configured to be visually recognized by a user outside the ink cartridge 30 via the residual ink indicator 33 comprising a translucent material. A user may be able to check a residual ink amount in the ink cartridge 30 by observing the sensor arm 60 configured to move in accordance with a residual ink amount in the ink cartridge 30.

As described above, the adaptor 90 may comprise the front wall 91 the upper wall 92, the side walls 93 and 94, and the bottom wall 96. In another embodiment, any of walls 91, 92, 93, 94, and 96 may be omitted. For example, referring to FIG. 9A, an adaptor 190 might not comprise the side wall 93. Further, both side walls 93 and 94 or the bottom wall 96 may be omitted. The opening 98 of the adaptor 90 through which the ink cartridge 30 attaches to the adaptor 90 might not have to be defined by four walls but may be defined by, for example, two or three walls.

Figure 9B:
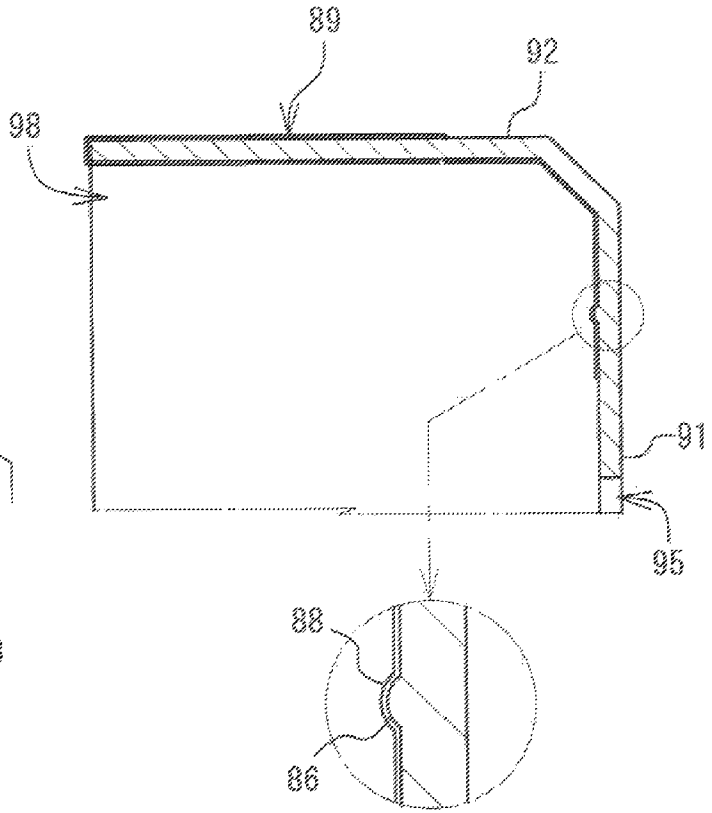
FIG. 9B is a partial cross-sectional view of the adaptor of FIG. 9A according to another embodiment of the present invention.
Figure 9A:
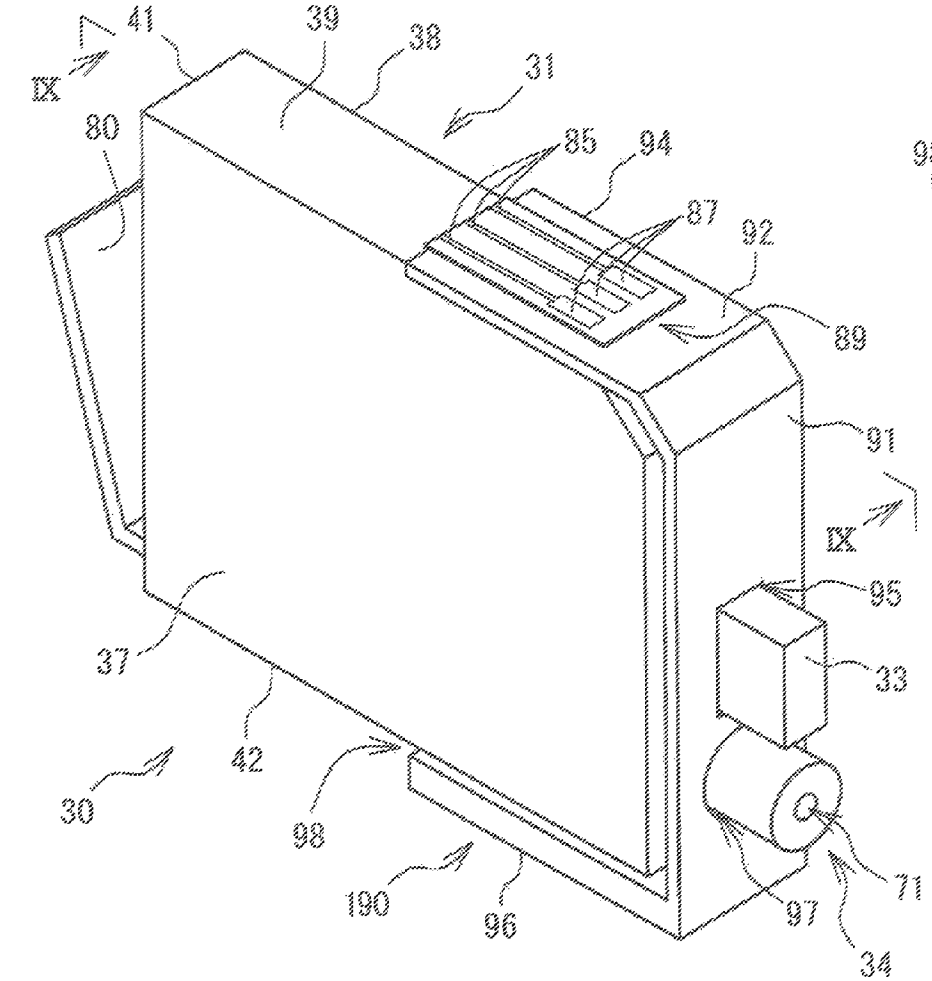
FIG. 9A is a perspective view of the ink cartridge and an adaptor according to another embodiment of the present invention.

As described above, the FPC 89 may be routed from the upper wall 92 to the front wall 91 of the adaptor 90, and then to an interior surface of the adaptor 90 via the opening 99. In another embodiment, the FPC 89 may be routed from the upper wall 92 of the adaptor 90 toward the opening 98 and then to an interior surface of the front wall 91 along an interior surface of the upper wall 92, as depicted in FIGS. 9A and 9B.

As described above, the residual ink indicator 33 of the ink cartridge 30 may be exposed via the opening 95 of the adaptor 90. In another embodiment, the adaptor 90 may have another opening through which a component of the ink cartridge 30 other than the residual ink indicator 33 may be exposed. For example, the ink cartridge 30 may comprise a rib extending from the front wall 40 of the ink cartridge 30 in the insertion direction 56. The optical sensor 114 may detect the rib when the ink cartridge 30 is mounted to the cartridge mounting portion 110. The adaptor 90 may have an opening through which the rib is exposed.

As described above, when the ink cartridge 30 attaches to the adaptor 90, a portion of the main body 31 on the side of the rear wall 41 may protrude from the opening 98 of the adaptor 90. In another embodiment, the front wall 40, the upper wall 39, the bottom wall 42, the side walls 37 and 38 of the main body 31 of the ink cartridge 30 may be completely covered by the adaptor 90.

As described above, the IC substrate 74 may be disposed at an upper portion of the front wall 40. In another embodiment, the IC substrate 74 may be disposed at any portion of the front wall 40. Even when the IC substrate 74 is disposed at any portion of the front wall 40, an interior surface of the adaptor 90 might not slide with the IC substrate 74 when the ink cartridge 30 attaches to the adaptor 90. If the IC substrate 74 is disposed at an upper portion of the front wall 40, distance between the IC substrate 74 and the ink outlet portion 34 disposed at a lower portion of the front wall 40 may become longer. Therefore, such possibilities that ink scattered from the ink outlet portion 34 adheres to the IC substrate 74 may be reduced.

As described above, the areas 87 of the FPC 89 may be disposed at the upper wall 92 of the adaptor 90. In another embodiment, the areas 87 may be disposed at the front wall 91, the side wall 93 and 94, or the bottom wall 96, other than the upper wall 92. As described above, when the areas 87 of the FPC 89 are disposed at the upper wall 92, the insertion direction 56 in which the adaptor 90 may be inserted into the case 101 of the cartridge mounting portion 110, the width direction 51 in which the light from the optical sensor 114 may pass, and the height direction 52 in which the contacts 106 may access or make contact with the respective areas 87 may be perpendicular to each other. Consequently, deviation of the positioning in one direction might not influence the positioning in other directions.

While the invention has been described in detail with reference to the specific embodiment thereof, this is merely an example, and various changes, arrangements and modifications may be applied therein without departing from the spirit and scope of the invention.

What is claimed is:

1. An ink containing device, comprising:

an ink cartridge comprising:

a main body including a first wall, a second wall spaced away from the first wall, and a third wall extending between the first wall and the second wall;

an ink outlet formed through the main body; and an electrical interface disposed on the first wall;

an adapter configured to be in an attached state with the ink cartridge comprising:

an adapter wall including an inner side configured to face the ink cartridge in the attached state and an outer side opposite the inner side, the outer side configured to be exposed to an exterior of the adapter in the attached state, the adapter wall including a particular wall portion configured to cover the first wall of the ink cartridge in the attached state;

a first electrode disposed on the inner side of the particular wall portion of the adapter wall;

a second electrode disposed on the outer side of the adapter wall; and a wiring connecting the first electrode with the second electrode, wherein the first electrode is configured to contact the electrical interface in the attached state, and wherein the adapter comprises a further wall portion of the adapter wall configured to cover the third wall portion of the ink cartridge in the attached state, and the second electrode is disposed on the outer side of the further wall portion.

2. The ink containing device according to claim 1, wherein an opening is formed through the adapter wall, and the wiring extends from the outer side of the further wall portion of the adapter wall to the inner side of the particular wall portion via the opening.

3. The ink containing device according to claim 1, wherein the wiring extends from the outer side of the further wall portion of the adapter wall to the inner side of the particular wall portion via the inner side of the further wall portion.

4. The ink containing device according to claim 1, wherein the ink cartridge comprises an ink detection mechanism comprises a light attenuating portion disposed at the first wall, wherein a further opening if formed in the particular wall portion of the adapter wall, and the light attenuating wall is configured to be exposed to an exterior of the adapter through the further opening in the attached state.

5. The ink containing device according to claim 4, wherein the ink detection mechanism comprises a movable member, and a portion of the movable member is the light attenuating portion.

6. The ink containing device according to claim 1, further comprising a memory configured to store data related to a color of the ink stored in a chamber of the ink cartridge disposed within the main body, wherein the memory is coupled to the electrical interface such that the memory is electrically connected to the electrical interface.

7. The ink containing device according to claim 1, wherein the second electrode protrudes toward the electrical interface in the attached state.

8. The ink containing device according to claim 1, wherein the wiring extends on the outer side of the further wall portion of the adapter wall along a particular direction towards the outer side of the particular wall portion, and the second electrode is disposed on the outer side of the further wall portion and offset with the wiring in a further direction which is perpendicular to the particular direction.

9. An adapter configured to be in an attached state with an ink cartridge, the adapter comprising:

a main body comprising a front side, a rear side opposite to the front side, an upper side between the front side and the rear side, and a bottom side opposite to the upper side, wherein the upper side comprises a particular surface facing a particular direction, and the front side comprises a further surface facing a further direction;

a first electrode disposed on the particular surface;

a second electrode disposed on the further surface; and a wiring which electrically connects the first electrode to the second electrode, wherein the first electrode is disposed farther than the second electrode from the further surface along the further direction.

10. The adapter according to claim 9, wherein the further surface is provided with the opening, and the opening is configured to expose a light attenuating portion of the ink cartridge to an exterior of the adapter through the opening in the attached state.

11. The adapter according to claim 9, wherein a width, extending along a width direction perpendicular to the particular direction and the further direction, of the first electrode is greater than a width of the wiring.

12. The adapter according to claim 9, wherein the first electrode and the wiring are offset in a width direction extending perpendicular to the particular direction and the further direction.

13. The adapter according to claim 9, wherein the adapter further comprises a flexible printed circuit including the first electrode, second electrode, and the wiring thereon.

14. An ink cartridge comprising:

a main body comprising a front side, a rear side opposite to the front side, an upper side between the front side and the rear side, and a bottom side opposite to the upper side, an ink outlet portion disposed on the front side, the ink outlet portion facing a first direction;

an electrical interface disposed on the front side; and an ink detection mechanism comprises a light attenuating portion disposed at the front side, wherein the light attenuating portion is disposed farther along the first direction than the electrical interface and the light attenuating portion is a particular distance away from the ink outlet portion along a second direction that is perpendicular to the first direction, and wherein the electrical interface is a farther distance away from the ink outlet portion in the second direction, and the further distance is greater than the particular distance.

15. The ink containing device according to claim 14, wherein the ink detection mechanism comprises a movable member, and a portion of the movable member is the light attenuating portion.

16. The ink cartridge according to claim 14, wherein the main body further comprises a front surface facing the first direction at the front side, and the electrical interface faces the first direction.

17. An ink containing device, comprising:

an ink cartridge comprising:

a main body including a first wall, a second wall spaced away from the first wall, and a third wall extending between the first wall and the second wall;

an ink outlet formed through the main body; and an electrical interface disposed on the first wall;

an adapter configured to be in an attached state with the ink cartridge comprising:

an adapter wall including an inner side configured to face the ink cartridge in the attached state and an outer side opposite the inner side, the outer side configured to be exposed to an exterior of the adapter in the attached state, the adapter wall including a particular wall portion configured to cover the first wall of the ink cartridge in the attached state;

a first electrode disposed on the inner side of the particular wall portion of the adapter wall;

a second electrode disposed on the outer side of the adapter wall; and a wiring connecting the first electrode with the second electrode, wherein the first electrode is configured to contact the electrical interface in the attached state, and wherein the adapter further comprises a flexible printed circuit including the first contact, second contact, and the wiring thereon.

* * * * *